United States Patent [19]

Gruber et al.

[11] Patent Number: 4,859,550

[45] Date of Patent: Aug. 22, 1989

[54] SMEAR RESISTANT MAGNETIC IMAGE CHARACTER RECOGNITION PROCESSES

[75] Inventors: Robert J. Gruber; Raphael F. Bov; Thomas D. Cometa, all of Pittsford; Paul W. Eakin; John S. Berkes, both of Webster; Bernard Grushkin, Pittsford, all of N.Y.

[73] Assignee: Xerox Corporation, Stamford, Conn.

[21] Appl. No.: 239,878

[22] Filed: Sep. 2, 1988

[51] Int. Cl.[4] ..... G03G 19/00

[52] U.S. Cl. ..... 430/39; 430/106.6; 430/110; 382/7

[58] Field of Search ..... 430/39, 98, 106.6, 110

[56] References Cited

U.S. PATENT DOCUMENTS

| | | | |
|---|---|---|---|
| 3,655,374 | 4/1972 | Palermiti et al. | 430/110 |
| 3,983,045 | 9/1976 | Jugle et al. | 430/112 |
| 4,072,521 | 2/1978 | Scouten et al. | 430/110 |
| 4,251,616 | 2/1981 | Hendriks | 430/107 |
| 4,287,282 | 9/1981 | Miyakawa et al. | 430/107 |
| 4,298,672 | 11/1981 | Lu | 430/108 |
| 4,338,390 | 7/1982 | Lu | 430/106 |
| 4,367,275 | 1/1983 | Aoki et al. | 430/99 |
| 4,513,074 | 4/1985 | Nash et al. | 430/106.6 |
| 4,517,268 | 5/1985 | Gruber et al. | 430/39 |
| 4,556,624 | 12/1985 | Gruber et al. | 430/110 |
| 4,557,991 | 12/1985 | Takagiwa et al. | 430/109 |
| 4,609,607 | 4/1986 | Takagi et al. | 430/106.6 |
| 4,626,487 | 12/1986 | Mitsuhashi et al. | 430/109 |
| 4,681,829 | 7/1987 | Grushkin | 430/109 |
| 4,758,493 | 7/1988 | Young et al. | 430/122 |

FOREIGN PATENT DOCUMENTS

| | | | |
|---|---|---|---|
| 51-18544 | 2/1976 | Japan | 430/98 |
| 56-87051 | 7/1981 | Japan | 430/110 |
| 56-144436 | 11/1981 | Japan | 430/110 |
| 1442835 | 7/1976 | United Kingdom . | |

OTHER PUBLICATIONS

Petrolite Specialty Polymers Group brochure on "Unilin TM Alcohols".

*Primary Examiner*—Roland E. Martin
*Attorney, Agent, or Firm*—E. O. Palazzo

[57] ABSTRACT

An electrophotographic process which comprises the generation of latent image; developing the image with a toner composition comprised of resin particles, magnetite particles, and an additive component comprised of an aliphatic hydrocarbon or a polymeric alcohol of the formula $$CH_3(CH_2)_nCH_2OH$$

wherein n is a number of from about 30 to about 500; and subsequently providing the developed image with magnetic ink characters thereon to a reader/sorter device whereby toner offsetting and image smearing is minimized in said device.

45 Claims, No Drawings

SMEAR RESISTANT MAGNETIC IMAGE CHARACTER RECOGNITION PROCESSES

BACKGROUND OF THE INVENTION

The present invention is generally directed to imaging processes with toner and developer compositions, and more specifically the present invention is directed to imaging and printing processes with toner compositions, including magnetic, single component, and two component, developer compositions particularly useful for generating documents such as personal checks which are subsequently processed in reader/sorters. In one embodiment of the present invention there are provided processes for generating documents, such as checks, including for example dividend checks, turn around documents such as invoice statements like those submitted to customers by American Express and VISA, corporate checks, highway tickets, rebate checks, other documents with magnetic codes thereon, and the like, with no toner smearing. More specifically, in one embodiment the process of the present invention is accomplished with toner and developer compositions containing, especially as internal additives, low molecular weight hydrocarbons containing functional groups such as hydroxy, amides, amines, esters, or polymeric alcohols as illustrated herein, and wherein image smearing and offsetting of the toner to read and write heads, including offsetting to the protective foil that may be present on the aforesaid heads in magnetic ink character recognition processes and apparatus inclusive of, for example, the read and write heads present in MICR (magnetic ink character recognition) reader/sorters such as the commercially available IBM 3890 TM, NCR 6780 TM, reader/sorters from Burroughs Corporation, and the like. Some of the reader/sorter printers contain protective foils thereon, reference for example the IBM 3890 TM, and the problems associated with such protective foils as illustrated herein with respect to read and write heads with no foils are alleviated with the processes of the present invention. Accordingly, with the process utilizing the toner and developed compositions illustrated the problems of image smearing to, and offsetting from the read and write heads in magnetic ink character recognition apparatuses is substantially eliminated. Moreover, in another embodiment the present invention is directed to improved economical processes for generating documents such as personal checks suitable for magnetic image character recognition wherein image smearing and toner offsetting, including offsetting to read and/or write heads including those with protective foils thereon, or unprotected heads as indicated herein is avoided when such documents are processed in the aforementioned reader/sorters. Furthermore, in another embodiment of the present invention there is provided a process for applying to developed images subsequent to, or simultaneously with fusing, especially magnetic ink developed images such as personal checks, a layer of the aforementioned additives; and more specifically the polymeric alcohols illustrated herein and wherein image smearing to, and offsetting from the read and write heads in magnetic ink character recognition apparatuses is substantially eliminated. Thus, the toner compositions selected for the process of the present invention in an embodiment are comprised of resin particles, pigment particles, including magnetic components such as magnetites, and certain waxes such as those containing hydroxyl functionality. There is also provided in accordance with the present invention processes with positively or negatively charged toner compositions comprised of resin particles, pigment particles, waves especially those with hydroxyl functionality, and charge enhancing additives. In addition, the present invention is directed to processes with developer compositions comprised of the aforementioned toners, and carrier particles. Further, the processes of the present invention with the toner and developer compositions illustrated, including single component toners, enable reliable output copy quality and stable tribolectric charging properties for the toner compositions selected.

Toner offset is eliminated with the processes of the present invention, it is believed, because of the presence of the additives. Offset results from, for example, the developed toner image being removed from the MICR (magnetic ink character recognition) document, such as a check to the read and/or write heads contained in MICR readers such as the IBM 3890 TM and the NCR 6780 TM. When the aforesaid offset is eliminated or substantially reduced, the problem of image smearing onto the MICR documents, such as personal checks, is also avoided. Apparently, although it is not desired to be limited by theory the additive, such as the polymeric alcohol, functions as a lubricant against offset. By offset is meant, for example, that the toner is released from the document, such as personal checks, and transfer and sticks to the aforementioned read and/or write heads. As a result, toner is removed from the checks, or other documents as illustrated herein primarily in a continuous manner causing image smearing, and substantially preventing the characters on the checks from being read magnetically and thus rejected in most instances. With the processes of the present invention, these problems are avoided, and more specifically the reject rate is less than one half of 1 percent for 5,000 checks processed through, for example, in the aforesaid IBM 3890 TM reader/sorter 20 times (a reject amount of about 15). Thus, with the process of the present invention, the reject rate is less than one half of 1 percent, it being noted that the acceptable reject rate usually does not exceed one half of 1 percent (0.5 percent), as determined by the American National Standards Institute (ANSI). Typically, the reject rate with the process of the present invention is from about 0.05 to about 0.3 percent depending, for example, on the sorter set up conditions as contrasted to a reject rate in excess of one half of 1 percent, which is not acceptable, with processes utilizing toner and developer compositions that contain, for example, no polymeric wax or other additives therein. With toner build up on the read/write heads, the excess toner is released to the check document being processed causing image smearing, which is avoided with the processes of the present invention.

With further respect to the present invention, the process is particularly applicable to the generation of documents including personal checks, which have been fused with soft roll fusers. Fuser rolls such as silicon rolls or other conformable fuser rolls, reference for example the soft fuser rolls incorporated into the Xerox Corporation 4040 TM machine, are particularly useful with the processes of the present invention.

The documents, including the personal checks mentioned herein, can be obtained, for example, by generating a latent image thereon and subsequently developing the image, reference U.S. Pat. No. 4,517,268, the disclosure of which is totally incorporated herein by reference, with the toner and developer compositions illustrated herein. The developed image that has been created, for example, in the Xerox Corporation 9700 TM MICR printer, reference the aforesaid '268 patent, contains thereon, for example, the characters zero, 1, 2, 3, 4, 5, 6, 7, 8, and 9, and up to four symbols (E-13B and CMC-7 font), which characters are magnetically readable by the IMB 3809 TM, or other similar apparatus. One of the problems avoided with the processes of the present invention is to eliminate or reduce the offsetting of the toner as indicated herein to the read and write heads in the apparatus selected for this purpose such as the IBM 3890 TM.

Developer and toner compositions with certain waxes therein are known. For example, there are disclosed in U.K. Patent Publication 1,442,835 toner compositions containing resin particles, and polyalkylene compounds, such as polyethylene and polypropylene of a molecular weight of from about 1,500 to 6,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. In addition, many patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference Palmeriti et al. U.S. Pat. No. 3,635,704, issued Jan. 18, 1972, the disclosure of which is totally incorporated herein by reference. Additionally, there are illustrated in U.S. Pat. No. 3,983,045 three component developed compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxypolyethylene glycols; terephthalic acids; and the like, reference column 7, lines 13 to 43.

Described in U.S. Pat. No. 4,367,275 are methods of preventing offsetting of electrostatic images of the toner compositions to the fuser roll, which toner subsequently offsets to supporting substrates such as papers wherein there are selected toner compositions containing specific external lubricants including various waxes, see column 5, lines 32 to 45, which waxes are substantially different in their properties and characteristics than the polymeric alcohol waxes selected for the toner and developer compositions of the present invention; and moreover, the toner compositions of the present invention with the aforementioned polymeric alcohol additives possess advantages, such as elimination of toner spotting, not achievable with the toner and developer compositions of the '275 patent.

Other references of interest which disclose, for example, the use of amides as toner additives include U.S. Pat. Nos. 4,072,521; 4,073,649; and 4,076,641. Furthermore, references of background interest are U.S. Pat. Nos. 3,165,420; 3,236,776; 4,145,300; 4,271,249; 4,556,624; 4,557,991; and 4,604,338.

Of particular interest with respect to the present invention is copending application U.S. Ser. No. 004,939, the disclosure of which is totally incorporated hereinby reference, excluding those portions relating to colored toners, which application illustrates toner compositions including magnetic single component, and colored toner compositions containing certain polymeric alcohol waxes. More specifically, there is disclosed in the copending application the elimination of toner spots, or comets with developer compositions comprised of toner compositions containing resin particles, particularly styrene butadiene resins, pigment particles such as magnetites, carbon blacks or mixtures thereof, polymeric hydroxy waxes available from Petrolite, which waxes can be incorporated into the toner compositions as internal additives or may be present as external components, it being noted that with the processes of the present invention these additives are usually present as internal components; and optional charge enhancing additives, particularly, for example, distearyl dimethyl ammonium methyl sulfate, reference U.S. Pat. No. 4,560,635, the disclosure of which is totally incorporated herein by reference, and carrier particles. As preferred carrier components for the aforementioned compositions, there are selected steel or ferrite materials, particularly with a polymeric coating thereover, including the coatings as illustrated in U.S. Ser. No. 751,922, entitled Developer Composition with Specific Carrier Particles, the disclosure of which is totally incorporated herein by reference. One particularly preferred coating illustrated in the aforementioned copending application is comprised of a copolymer of vinyl chloride and trifluorochloroethylene with conductive substances dispersed in the polymeric coating inclusive of, for example, carbon black. One embodiment disclosed in the aforementioned copending application is a developer composition comprised of styrene butadiene copolymer resin particles, and charge enhancing additives selected from the group consisting of alkyl pyridinium halides, ammonium sulfates, and organic sulfate or sulfonate compositions; and carrier particles comprises of a core with a coating of vinyl copolymers, or vinyl homopolymers. The polymeric components of the aforesaid copending application are also selected for various embodiments of the present invention as illustrated herein.

In a Petrolite, Inc. brochure, dated 1985 there are disclosed polymeric hydroxy waxes, which brochure indicates that the waxes may have utility as toner.

In U.S. Pat. No. 4,517,268, the disclosure of which is totally incorporated herein by reference, there is illustrated a process for generating documents such as personal checks suitable for magnetic image character recognition, which process involves generating documents in high speed electronic laser printing devices. The developer composition disclosed in this patent is comprised of, for example, magnetic particles, such as magnetite, certain styrene resin particles, and the carrier particles as illustrated in the Abstract of the Disclosure. Additive particles may also be included in the developer compositions of this patent.

Moreover, toner and developer compositions containing charge enhancing additives, especially additives which impart a positive charge to the toner resin, are well known. Thus, for example, there is described in U.S. Pat. No. 3,893,935 the use of certain quaternary ammonium salts as charge control agents for electrostatic toner compositions. There is also described in U.S. Pat. No. 2,986,521 reversal developer compositions comprised of toner resin particles coated with finely divided colloidal silica. According to the disclosure of this patent, the development of images on negatively charged surfaces is accomplished by applying a developer composition having a positively charged triboelectric relationship with respect to the colloidal silica. Further, there is illustrated in U.S. Pat. No. 4,338,390, the disclosure of which is totally incorporated herein by reference, developer and toner compositions having incorporated therein as charge enhancing additives organic sulfate and sulfonate compositions; and in U.S. Pat. No. 4,298,672, the disclosure of which is totally incorporated herein by reference, positively charged toner compositions containing resin particles and pigment particles, and as a charge enhancing additive alkyl pyridinium compounds, inclusive of cetyl pyridinium chloride.

Other prior art disclosing positively charged toner compositions with charge enhancing additives include U.S. Pat. No. 3,944,493; 4,007,293; 4,079,014; and 4,394,430.

Although the above described toner and developer compositions are useful for their intended purposes, there is a need for improved compositions. More specifically, there is a need for process enabling the generation of documents such as personal checks, with single and two component toner and developer compositions wherein toner offsetting and image smearing is avoided. There is also a need for the generation of developed images including the generation of personal checks in laser printers utilizing magnetic ink character recognition technology, wherein toner offset to protective foils present on the read and write heads is avoided, and image smearing is eliminated by adding to the toner, preferably as an internal additive, low molecular weight, less than about 20,000 weight average, aliphatic hydrocarbons; and especially polymeric alcohols. In addition, there is a need for MICR processes for generating documents such as personal checks with toner and developer compositions that maintain their triboelectrical characteristics for extended time periods exceeding, for example, 450,000 developed images. In addition, there is a need for MICR processes with toner and developer compositions wherein toner offsetting to protective foils, and image smearing on documents generated is reduced or eliminated. Furthermore, there is a need for processes wherein image smearing and offsetting is avoided by, for example, applying to the developed image by, for example, a hot roll applicator subsequent to, or during fusing a layer of additives including the polymeric hydroxy waxes illustrated herein.

SUMMARY OF THE INVENTION

It is an object of the present invention to provide toner and developer compositions, processes for obtaining images thereof, and particularly processes for generating documents such as personal checks which are subsequently processed in reader/sorters with many of the advantages illustrated herein.

Another object of the present invention resides in the provision of processes for generating documents, such as personal checks, suitable for magnetic ink character recognition, which processes utilize toner and developer compositions containing polymeric hydroxy waxes.

In another object of the present invention there are provided processes for generating documents, such as personal checks, suitable for magnetic ink character recognition, which processes utilize toner and developer compositions containing aliphatic hydrocarbons without functional groups, with functional groups, including polymers hydroxy waxes wherein toner offsetting, and image smearing is avoided.

Moreover, another object of the present invention relates to processes wherein toner offsetting to the read and write heads, including those that are not protected, or those that contain a protective foil thereon, is avoided.

In another object of the present invention, there are provided processes for processing documents wherein offsetting and image smearing are avoided.

Also, in another object of the present invention there are provided processes wherein, for example, image smearing and toner offsetting is avoided when documents such as checks containing magnetic characters thereon are utilized in commercial sorters, and/or reader/sorters.

Additionally. in yet another object of the present invention there are provided magnetic ink character recognition procesess (MICR), which processes are suitable for the generation of documents with toner and developer compositions containing polymeric alcohols, and wherein these checks can be utilized in commercial sorters, and/or reader/sorters such as the IBM 3890 TM without toner offsetting and image smearing as illustrated herein.

Also, in another object of the present invention there are provided processes for applying to developed images various additives including polymeric alcohols primarily for the purposes of eliminating image smearing and toner offsetting in commercial sorters, and/or reader/sorters such as the IBM 3890 TM, and the NCR 6780 TM with toner and developer compositions containing polymeric alcohols.

Additionally, in still another object of the present invention there are provided methods for avoiding offsetting and image smearing by the application of a layer of additive materials, such as the polymeric alcohols or aliphatic hydrocarbons illustrated herein, to the developed fused MICR image simultaneously with fusing or subsequent to fusing.

In another important object of the present invention there are provided processes for generating documents such as personal checks suitable for magnetic image character recognition, which processes utilize toner and developer compositions containing additives such as polyhydroxy waxes, and wherein the characters present on the documents are fused with a soft fuser roll, and wherein these documents can be utilized in commercial sorters such as the IBM 3890 TM and the NCR 6780 TM without toner offsetting and image smearing as illustrated herein.

These and other objects of the present invention are accomplished by providing processes with developer compositions and toner compositions that are useful for generating documents inclusive of personal checks, which documents are subsequently processed in reader/sorter devices as illustrated herein. More specifically, the present invention is directed to processes for generating documents, which comprise the formation of images, such as latent images with a printing device especially devices generating from about 8 to about 135 prints per minute; developing the image with a single, or two component developer composition (toner +carrier) as illustrated herein, which compositions contain, for example, resin particles, magnetite particles, low molecular weight hydrocarbons with functional groups, or the polymeric alcohols illustrated herein; subsequently transferring the developed image to a suitable substrate; permanently affixing the image thereto, and thereafter processing the documents in reader/sorters wherein image offsetting and image smearing are avoided or substantially reduced. Some examples of the aforementioned process wherein a toner with no hydrocarbon, or polymeric alcohol additive is selected is illustrated in U.S. Pat. No. 4,517,268, especially column 3, the disclosure of which is totally incorporated herein. Examples of high speed electronic printing devices disclosed in the aforementioned patent, which devices can also be utilized for the process of the present invention, include the 8700 TM, and 9700 TM MICR printer available from Xerox Corporation. More specifically, there can be selected for the generation of the documents with magnetic characters thereon the Xerox Corporation 9700 TM MICR printer, about 120 prints per minute, the Xerox Corporation 8700 TM MICR printer, about 80 prints per minute, and the like. Also, there can be selected for the processes of the present invention other devices including ionographic printers such as the Delphax 4060 TM printers, the Xerox Corporation 4040 TM, which contains a soft fuser roll for fixing purposes, the Xerox Corporation 4045 TM and 4050 TM Thereafter, the formed documents with magnetic characters thereon are processed in reader/sorter apparatuses as illustrated herein, and there results the advantages as indicated including low reject rates.

One specific embodiment of the present invention is directed to a process for obtaining images which comprises the generation of a latent image and developing the latent images with a toner composition comprised of resin particles, pigment particles, magnetic particles, such as magnetite, and an additive component comprised of an aliphatic hydrocarbon, or polymeric alcohols of the formula $$CH_3(CH_2)_nCH_2OH$$

wherein n is a number of from about 30 to about 500, and preferably 300. Another embodiment of the present invention is directed to an electrophotographic process for obtaining images, which comprises the generation of a latent image in an electronic printing device; thereafter developing the characters with a toner composition comprised of resin particles, pigment particles, magnetite particles, and an additive component comprised of an aliphatic hydrocarbon or polymeric alcohols of the formula $$CH_3(CH_2)_nCH_2OH$$

wherein n is a number of from about 30 to about 300, and subsequently processing the documents with magnetic characters thereon in reader/sorters. Also, in a further embodiment of the present invention there is provided a xerographic process, which comprises forming a latent image on an imaging member; developing the image with a toner composition comprised of resin particles, magnetite particles, and pigment particles; subsequently transferring the image to a suitable substrate; fixing the image thereto; simultaneously, or thereafter applying to the developed image an aliphatic hydrocarbon or a polymeric alcohol of the formula $$CH_3(CH_2)_nCH_2OH$$

wherein n is a number of from about 30 to about 500, and preferably 300; and subsequently processing the documents with magnetic characters thereon in a reader/sorter. The aforementioned developed images, especially personal checks with magnetic characters thereon, can then be utilized in a reader/sorter without offsetting and image smearing as indicated herein.

The toner compositions selected for the process of the present invention are comprised of resin particles, magnetites, and optional pigment particles, such as carbon black and aliphatic hydrocarbons containing functional groups, such as polymeric alcohols with hydroxyl functionality. In one embodiment of the present invention, there are selected for the process of the present invention toner compositions comprised of resin particles, magnetite particles, optional pigment particles, and certain polymeric alcohol waxes, which waxes are available from Petrolite Corporation. Furthermore, there are provided in accordance with the present invention processes with positively or negatively charged toner compositions comprised of resin particles, pigment particles, magnetite particles, polymeric alcohol waxes, and charge enhancing additives. Another embodiment of the present invention is directed to processes with developer compositions comprised of the aforementioned toners; and carrier particles. Additionally, the toner compositions selected may include as additives, preferably external additives, in amounts, for example, of from about 0.1 to about 1.0 percent, and preferably 0.5 percent by weight of silica such as Aerosil R972, metal salts, metal salts of fatty acids such as zinc stearate, and the like, reference U.S. Pat. Nos. 3,720,617; 3,900,588; and 3,590,000 the disclosures of which are totally incorporated herein by reference.

Illustrative examples of suitable toner resins selected for the toner and developer compositions and present in various effective amounts, providing the total amount of all components is equal to about 100 percent by weight, such as, for example, from amount 40 percent by weight to about 80 percent by weight, include polyesters, polyamides, epoxy resins, polyurethanes, polyolefins, vinyl resins and polymeric esterification products of a dicarboxylic acid, and a diol comprising a diphenol. Various suitable vinyl resins may be selected as the toner resin including homopolymers or copolymers of two or more vinyl monomers. Typical vinyl monomeric units include styrene, p-chlorostyrene, unsaturated mono-olefins such as ethylene, propylene, butylene, isobutylene, and the like; vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, and butyl methacrylate; acrylonitrile, methacrylonitrile, acrylamide; vinyl ethers such as vinyl methyl ether, vinyl isobutyl ether, and vinyl ethyl ether; styrene butadiene copolymers, especially styrene butadiene copolymers prepared by a suspensions polymerization process, reference U.S. Pat. No. 4,558,108, the disclosure of which is totally incorporated herein by reference; and mixtures thereof.

As one preferred toner resin there can be selected the esterification products of a dicarboxylic acid and a diol comprising a diphenol, which components are illustrated in U.S. Pat. No. 3,590,000, the disclosure of which is totally incorporated herein by reference. Other preferred toner resins included styrene/methacrylate copolymers, styrene/acrylate copolymers, and styrene/butadiene compolymers, especially those as illustrated in the aforementioned patent; and styrene butadiene resins with high styrene content, that is exceeding from about 80 to 85 percent by weight of styrene, which resins are available as Pliolites from Goodyear Chemical Company; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol, and pentaerythritol.

Examples of magnetites selected for the toner and developer compositions utilized for the process of the present invention include those commercially available such as Mapico Black, which magnetites are generally present in the toner composition in an amount of from about 35 percent by weight to about 70 percent by weight, and preferably in an amount of from about 50 percent by weight to about 60 percent by weight. Alternatively, there can be selected mixtures of magnetities with pigment particles such as carbon black or equivalent pigments, which mixtures, for example, contain from about 35 percent to about 60 percent by weight of magnetite, and from about 0.5 percent to about 10 percent by weight of carbon black. Also, there may be selected hard, or acicular magnetities in amounts of from about 15 to about 40, and preferably from about 20 to about 30 percent by weight. Examples of hard magnetites include MO4232 available from Pfizer Chemical. The toner polymer is usually present in an amount of from about 30 to about 85 percent by weight.

Illustrative examples of optional charge enhancing additives present in various effective amounts such as, for example, from about 0.05 to about 10 percent by weight, and more preferably from about 0.5 to about 2 percent by weight, and enabling positively charged toner compositions with a triboelectric charge, for example, of from about 15 to about 40 microcoulombs per gram include alkyl pyridinium halides, such as cetyl pyridinium chlorides, reference U.S. Pat. No. 4,298,672, the disclosure of which is totally incorporated herein by reference; cetyl pyridinium tetrafluoroborates, quaternary ammonium sulfate, and sulfonate charge control agents as illustrates in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; and other known similar charge enhancing additives providing the objectives of the present invention are accomplished; and the like. Examples of charge enhancing additives present in various effective amounts, such as, for example, from about 0.05 to about 10 percent by weight, and preferably from about 1 to about 5 percent by weight, and more preferably from about 0.5 to about 2 weight percent that enable negatively charged toners with a triboelectric charge, for example, of from about −15 to about −40 microcoulombs per gram include Spilon TRH available from Hodagaya Chemical, orthohalophenylcarboxylic acids, reference U.S. Pat. No. 4,411,974, the disclosure of which is totally incorporated herein by reference, potassium tetraphenyl borates, and the like.

With further respect to the toner and developer compositions selected for the processes of the present invention, an important component present therein that enables many of the advantages illustrated herein to be obtained is the aliphatic hydrocarbon waxes, such as the Bareco's (Polywaxes) which are believed to be low molecular weight polyethylenes available from Petrolite Corporation, or linear polymeric alcohol comprised of a fully saturated hydrocarbon backbone with at least about 80 percent of the polymeric chains terminated at one chain end with a hydroxyl group, which alcohol is represented by the following formula:

$$CH_3(CH_2)_nCH_2OH$$

wherein n is a number of from about 30 to about 500, preferably of from about 30 to about 300, and more preferably from about 30 to about 100, which alcohols are available from Petrolite Corporation. Particularly preferred polymeric alcohols include those wherein n represents a number of from about 30 to about 100, and preferably 40 to about 70. Therefore, in a preferred embodiment of the present invention the polymeric alcohols selected have a number average molecular weight as determined by gas chromatography of from about greater than 450 to about 1,400, and preferably of from about 475 to about 750. In addition, the aforementioned polymeric alcohols are present in the toner and developer compositions illustrated herein in various effective amounts, and are usually added as uniformly dispersed internal additives. More specifically, the polymeric alcohols are present in an amount of from about 1 percent to about 20 percent by weight. Therefore, for example, as internal additives the polymeric alcohols are preferably present in an amount of from about 1 percent by weight to about 8 percent by weight, while as external additives in a less preferred embodiment the polymeric alcohols may be present in an amount of from about 0.5 percent by weight to slightly less than about 5 percent by weight. Toner and developer compositions with the waxes present internally are formulated by initially blending the toner binder resin particles, pigment particles, and polymeric alcohols, and other optional components. In contrast, when the polymeric alcohols are present as external additives, the toner composition is initially formulated comprised of, for example, resin particles and pigment particles; and subsequently there is added thereto finely divided polymeric alcohols.

Although it is not desirable to be limited by theory, it is believed that the aforementioned linear polymeric alcohols possess very narrow polydispersity, that is the ratio of Mw/Mn is equal to or less than about 1:1 in one preferred embodiment; and moveover, these alcohols possess high crystallinity with a density of about 0.985. By high crystallinity is meant that the linear polymeric alcohol molecular chains possess a high degree of molecular order in their solid state molecular structure; and also possess zero to very few defects in this ordered molecular structure, and exhibit a sharp primary transition or melting point, reference for example the text Marcomolecule Structure and Properties, Vol. 1, authored by Hans Georg Elias (1984), particularly Chapter 5, pages 151 to 154. Accordngly, it is believed that the waxes selected for the present invention especially those encompassed by the formula illustrated herein possess properties that are unique for polymeric waxes inclusive of substantially complete saturation, high linearity, crystallinity, narrow molecular weight distributions, and primary alcohol functionality or no functionality in some instances. In addition, these waxes possess the appropriate hardness and toughness properties enabling the resulting toner and developer compositions to be readily attritable to fine particle sizes of less than, for example, about 15 micrometers average diameter.

Of importance with respect to the processes of the present invention is the presence of the aforementioned polymeric alcohols, or aliphatic hydrocarbons with functional groups as indicated herein, which hydrocarbons have a molecular weight average of from less than about 20,000, and preferably from about 500 to about 2,000. It is believed that it is these components which, in combination with the other components of the toner and/or developer, eliminate, substantially reduce or minimize toner offsetting, including offsetting to the protective foil present on the read and write heads of reader/sorters present, for example, in the IBM 3890 TM apparatus, and substantially eliminates image smearing.

Illustrative examples of carrier particles that can be selected for mixing with the toner compositions, thus permitting two component developers that can be selected for the process of the present invention include those particles that are capable of triboelectrically obtaining a charge of opposite polarity to that of the toner particles. Accordingly, the carrier particles can be selected to be of a negative polarity thereby enabling the toner particles which are positively charged to adhere to and surround the carrier particles. Alternatively, there can be selected carrier particles with a positive polarity enabling toner compositions with a negative polarity. Illustrative examples of carrier particles that may be selected include steel, nickel, iron, ferrites, and the like. Additionally, there can be selected as carrier particles nickel berry carries as disclosed in U.S. Pat. No. 3,847,604, which carriers are comprised of nodular carrier beads of nickel characterized by surfaces of reoccurring recesses and protrusions thereby providing particles with a relatively large external area. Preferred carrier particles selected for the present invention are comprised of a magnetic, such as steel, core with a polymeric coating thereover several of which are illustrated, for example, in U.S. Ser. No. 751,922 relating to developer compositions with certain carrier particles, the disclosure of which is totally incorporated herein by reference. More specifically, there are illustrated in the aforementioned copending application carrier particles comprised of a core with a coating thereover of vinyl polymers, or vinyl homopolymers. Examples of specific carriers illustrated in the copending application, and particularly useful for the present invention are those comprised of a steel or ferrite core with a coating thereover of a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride and trichlorofluoroethylene; and other known coatings. There can also be selected as carriers components comprised of a core with a double polymer coating thereover, reference U.S. Ser. Nos. 136,791, and 136,792, the disclosures of which are totally incorporated herein by reference. More specifically, there is detailed in these applications a process for the preparation of carrier particles with substantially stable conductivity parameters which comprises (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary, generally they are of a diameter of from about 50 microns to about 1,000 microns, thus allowing these particles to possess sufficient density to avoid adherence to the electrostatic images during the development process. The carrier particles can be mixed with the toner particles in various suitable combinations, however, best results are obtained when about 1 to about 5 parts per toner to about 10 parts to about 200 parts by weight of carrier are mixed.

The toner compositions illustrated herein can be prepared by a number of known methods, including mechanical blending and melt blending the toner resin particles, pigment particles or colorants, and polymeric alcohols followed by mechanical attrition. Other methods include those well known in the art such as spray drying, mechanical dispersion, melt dispersion, dispersion polymerization, and suspension polymerization. More specifically, the toner compositions are prepared by the simple mixing of polymeric resin, magnetitie, and additives particles while heating, followed by cooling, micronization to enable toner size particles of, for example, an average diameter of from about 10 to about 25 microns, and subsequently classifying these particles for the primary purpose of removing fines, that is for example particles with a diameter of 5 microns or less, and very large course particles, that is with a diameter of greater than 30 microns. Also, the aforementioned toners can be prepared in a similar manner with an extrusion device wherein the product exiting from such a device is severed into pieces followed by micronization and classification.

As indicated herein, the toner and developer compositions of the present invention may be selected for use in developing images in electrophotographic imaging systems, containing therein, for example, conventional photoreceptors, such as selenium and selenium alloys. Also useful, especially wherein there is selected positively charged toner compositions, are layered photoresponsive devices comprised of transport layers and photogenerating layers, reference U.S. Pat. Nos. 4,265,990; 4,585,884; 4,584,253; and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines, and vanadyl phthalocyanines, while examples of charge transport layers include the aryl amines as disclosed in U.S. Pat. No. 4,265,990. Other photoresponsive devices useful in the present invention include 4-dimethylaminobenzylidene, 2-benzylidene-amino-carbazole; 4-dimethamino-benzylidene; (2-nitro-benzlidene)-p-bromoaniline; 2,4-diphenyl-quazoline; 1,2,4-triazine; 1,5-diphenyl-3-methyl pyrazoline; 2-(4'-dimethyl-amino phenyl)-benzoaxzole; 3-aminocarbazole; hydrazone derivatives; polyvinyl carbazole-trinitrofluorenone charge transfer complex; and mixtures thereof. Moreover, there can be selected as photoconductors hydrogenated amorphous silicon, and as photogenerating pigments squaraines, perylenes, and the like.

An especially preferred developer composition of the present invention is comprised of a toner composition with styrene butadiene resin particles (91/9), about 32 percent by weight of magnetite, available as MO4232, about 2 percent by weight of carbon black, about 1.0 percent by weight of the charge enhancing additive distearyl dimethyl ammonium methyl sulfate, and as an internal additive about 7 percent by weight of the polymeric alcohol illustrated herein, and carrier particles comprised of a steel core with a coating thereover of a polymer of, for example, a vinyl chloride/trichlorofluoroethylene copolymer available as FPC 461, which coating has dispersed therein conductive components such as carbon black particles.

As preferred magnetites selected for the toner compositions for the processes of the present invention, the magnetites as illustrated in U.S. Pat. No. 4,517,28, the disclosure of which is totally incorporated herein by reference, are utilized.

Illustrative examples of aliphatic hydrocarbons that may be selected as additives in place of the polymeric alcohols, include CeraLube 54, an amide modified polypropylene was available from Shamrock Chemical Company; Ceralube 363, a modified polyethylene was available from Shamrock Chemical Company; Bareco 500, 1,000, and 2,000, low molecular weight polyethylenes with, it is believed, no functional groups, available from Petrolite, Inc., and the like. Preferred polymeric alcohols, which are available from Petrolite, include Unilin 700, 1,000 and 2,000.

A further embodiment of the present invention relates to the provision of processes for generating images, including the generation of personal checks as indicated herein wherein subsequent to, or simultaneously with development and fusing, especially soft roll fusing, there is applied to the image the polymeric alcohols, or the aliphatic hydrocarbon components illustrated herein. These components are generally applied from a hot roll applicator to the developed, fused MICR images. In this manner, image smearing, and toner offset to the read and write heads in the MICR reader/sorter is avoided. Generally, the aforesaid layer is present in an effective thickness, for example from about 0.1 to about 5 microns. Also, the layer can be present as a continuous or semicontinuous component.

With further respect to the present invention, there is provided in specific embodiments a process, including a xerographic process which comprises generating a latent image; developing the image which contains magnetic characters thereon, such as personal checks and the other documents illustrated herein with a toner composition comprised of resin particles, optional pigment particles, magnetic particles, and an additive component comprised of aliphatic hydrocarbon, or polymeric alcohols of the formula illustrated herein; and thereafter processing the documents obtained in a reader/sorter and a xerographic process which comprises forming a latent image on an imaging member; developing the image with a toner composition comprised of resin particles and pigment partricles; subsequently transferring the image to a suitable substrate; subsequently permanently affixing the image by, for example, heating or a combination of heating and pressure; and thereafter, or simultaneously applying to the developed image, such as characters present on a personal check document, an aliphatic hydrocarbon as illustrated herein, or a polymeric alcohol of the formula $$CH_3(CH_2)_nCH_2OH$$

wherein n is as defined herein. The aforementioned documents as indicated herein are then processed in reader/sorters, such as the IBM 3890 TM, without undersirable image smearing or imaging offsetting.

The toner composition selected for the processes of the present invention may include as surface additives colloidial silicas, such as R972, metal salts, or metal salts of fatty acids, in amounts of from about 0.1 to about 1 percent for example.

With the process of the present invention, radiant, fusing, flash fusing, vapor fusing, and fusing with hard or soft rolls can be utilized. When hard roll fusing is selected, reference the 9700 TM MICR printer mentioned herein, the toner pile height is from about 5 to about 9 microns, and the image offsetting or image smearing advantages indicated are obtained with the toner and developer compositions illustrated, which advantages are not achieved with such compositions when the additives, such as the polymeric alcohols, are not present in the toner. Similar results are obtained with soft fuser rolls wherein the toner pile height is from about 9 to about 20 microns. With the aforesaid soft fuser rolls particularly, there results image smearing and offsetting in the reader/sorters when toners without the waxes illustrated herein are utilized. Accordingly, with the process of the present invention image smearing and image offsetting advantages are obtained as indicated herein, and less sorter machine contamination is present while simultaneously satisfying ultimate users as the aforesaid and other problems are minimized, especially when soft roll fusers are selected for fixing of the images, reference the Xerox Corporation 4040 TM.

The following examples are being submitted to further define various species of the present invention. These examples are intended to illustrate and not limit the scope of the present invention. Also, parts and percentages are by weight unless otherwise indicated.

EXAMPLE I

There was prepared by melt blending with heating, followed by mechanical attrition, a toner composition comprised of 61 percent by weight of styrene butadiene resin with 91 percent by weight of styrene and 9 percent by weight of butadiene, 32 percent by weight of the magnetite MO 4232, which toner had incorporated as an internal component 7 weight percent of a linear polymeric alcohol, available from Petrolite Corporation, of the formula as illustrated herein with a number average molecular weight of about 700, that is where n is a number of about 48 as determined by gas chromophotography, and with an average particle size diameter of 10 micrometers. Also included on the surface of the toner was 0.3 percent by weight of Aerosil R972.

The aforementioned toner composition had a triboelectric charge thereon of a minus −15.5 microcoulombs per gram with the following carriers as determined by the known Faraday cage apparatus.

Subsequently, there was prepared a developer composition by admixing the aforementioned formulated toner composition at a 4.5 percent toner concentration, that is 4.5 parts by weight of toner per 100 parts by weight of carrier, which carrier was comprised of a ferrite core, available from Titan Corporation, with a 0.6 weight percent polymeric coating, 80 percent by weight thereover of a terpolymer of styrene, methylmethacrylate, and triethoxy silane containing 20 percent by weight of Vulcan XC72R carbon black available from Pfizer, reference U.S. Pat. No. 4,517,268, the disclosure of which is totally incorporated herein by reference.

The aforementioned developer composition was utilized to develop latent images generated in the Xerox Corporation 9700 TM MICR apparatus, commercially available, which images were fused with a hard roll fuser, resulting in personal checks with magnetic characters thereon. When these checks, about 5,000, were utilized in the IBM 3890 TM with a reader/sorter toner offsetting to the protective foils present on the read and write heads as minimized as evidenced by visual observation, and image smearing did not result on the final images as determined by visual observation. More specifically, 5,000 of the aforementioned created checks were passed through an IBM 3890 TM sorter 20 times, and the reject rate, that is where the magnetic image characters could not be read, was 0.1 percent or 5 beginning with the first pass and continuing up to the 20th pass, and image smearing was avoided. Thus, out of a total of 100,000 checks processed in the aforesaid reader/sorter only 5 were rejected. When repeating the aforementioned process with the exception that there was selected a toner and developer composition without the linear polymeric alcohol available from Petrolite Corporation, the protective foil on the read/write heads was contaminated with toner; it being noted that less toner contamination resulted on the aforesaid foils when the same toner and developed were utilized containing the linear polymeric alcohol wax available from Petrolite. When the above process was repeated in the NCR 6780 TM, which contains no protective foils on the read and write heads, less toner contamination was noted on the read and write heads as with the toner and developer containing the polymeric alcohol compared to the utilization of a toner containing no linear polymeric alcohol. In view of this, it is believed that machine maintenance can be reduced since there is less toner contamination present.

Also, similar toner and developer compositions can be prepared and utilized for generating and utilizing checks with substantially similar desirable offsetting and image smearing results, and wherein the polymeric alcohol can be present in an amount of from about 2 to about 15, and preferably from about 4 to about 6.9 percent by weight.

Further, there were prepared similar toner and developer compositions with the exceptions that there was selected in place of the polymeric alcohol Bareco 1000, a polyethylene available from Petrolite Chemical. When checks formed with the aforementioned developer compositions were utilized in the IBM 3890 TM as illustrated above the reject rate was less than 0.08 percent. Toner offsetting to the read and write heads was avoided as evidenced by visual observation, and image smearing did not result as determined by visual observation.

EXAMPLE II

A positively charged toner composition with a triboelectric charge thereon of 18 microcoulombs per gram was prepared by repeating the procedure of Example I with the exceptions that 35 percent of the magnetite, 3 percent of the polymeric alcohol component (Unilin 700), and 1 percent by weight of the charge enhancing additive distearyl dimethyl ammonium methylsulfate were selected. A developer composition was then prepared by repeating the procedure of Example I with the exception that the carrier particles were comprised of a core of Toniolo steel with a double dry powder coating thereover comprised of 50 percent by weight of polymethylmethacrylate, and 50 percent by weight of Kynar, a polyvinylidene fluoride available from Petrolite, at a coating weight of 0.7 percent.

Personal checks were then generated in the Xerox 4040 TM, wherein fixing of the developed images was accomplished with a soft silicone roll, and these checks were subsequently utilized (sorted) in the IBM 3890 TM by repeating the procedure of Example I, and substantially similar results were obtained, that is toner offsetting (contamination) to the read and write heads was substantially avoided as evidenced by visual observation, and image smearing did not result in the final images as determined by visual observation for 100,000 checks. The reject rate was 0.32 percent.

When the above process was repeated, and there was selected a positively charged toner composition containing 0 percent by weight of the polymeric alcohol component and 64 percent by weight of the styrene butadiene resin, significant undersirable accumulation of toner on the read and write heads foils resulted and the reject rate, which was unacceptable, was in excess of 1 percent.

EXAMPLE III

A single component toner composition was prepared by repeating the process of Example I wherein 47.47 percent by weight of a styrene n-buty methacrylate (58/32), 47.1 percent by weight of the magnetite Mapico Black, 0.68 percent by weight of the charge enhancing additive TRH available from Hodogaya, 2.43 percent by weight of 660P polypropylene available from Sanyo Chemical Company, and 3 percent by weight of the polymeric alcohol (Unilin 700) were selected. The toner had a negative charge thereon of a -17 microcoulombs per gram. Personal checks resulting from a Xerox Corporation laboratory printing device wherein the image (characters) were developers with the aforesaid toner were then sorted in the IBM 3890 TM by repeating the preocedure of Example I, and substantially similar results were obtained, that is toner offsetting to the read and write heads was minimized as evidenced by visual observation, and image smearing did not result on the final images as determined by visual observation. The reject rate was 0.45 percent.

EXAMPLE IV

Toner and developer was prepared by repeating the procedure of Example II, and thereafter the personal checks generated were utilized in the NCR 6780 TM. Substantially similar results were obtained, that is the reject rate was 0.2 percent as compared to an average reject rate of 1 percent with the same toner containing no polymeric alcohol wax.

EXAMPLE V

Personal check documents were prepared by repeating the process of Example I with the exception that the toner selected contained no linear polymeric alcohol was, and 68 percent by weight of the resin particles. Subsequent to fusing in each instance, there was applied by a silicone fuser roll to each of the checks generated a continuous layer, 2.5 microns in thickness, of the polymeric alcohol was of Example I. Subsequent to sorting in the IBM 3890 TM, the reject rate for 100,000 checks with the wax layer thereon was 0.4 percent.

A toner and developer composition was prepared by repeating the procedure of Example I with the exception that there was added thereto 2 percent by weight of Regal 330® carbon black as pigment particles, and there was selected 59 percent by weight of the styrene butadiene resin. Substantially similar results were obtained when the personal checks generated with magnetic characters thereon were utilized in the IBM 3890 TM with a reader/sorter. More specifically, the reject rate was 0.1 percent, and image smearing was minimized.

When the aforementioned toner and developer compositions were utilized in the Xerox Corporation 4045 TM wherein the images were fixed with a radiant fuser, substantially similar results were obtained as reported in Example II. Also, when a similar toner and developer composition without the polymeric component Unilin 700 was selected and personal checks generated in the Xerox Corporation 4045 TM, and subsequently sorted in the IBM 3890 TM, substantially similar results were obtained when reported in Example II, that is the reject rate was about 1 percent and toner contamination on the read/write heads resulted.

Other modifications of the present invention may occur to those skilled in the art subsequent to a review of the present application. The aforementioned modifications, including equivalents thereof, are intended to be included within the scope of the present invention.

What is claimed is:

1. An electrophotographic process which comprises the generation of a latent image; developing the image with a toner composition comprised of resin particles, magnetite particles, and an additive component comprised of an aliphatic hydrocarbon or a polymeric alcohol of the formula $$(CH_3(CH_2)_nCH_2OH$$

wherein n is a number of from about 30 to about 500; and subsequently providing the developed image with magnetic ink characters thereon to a reader/sorter device whereby toner offsetting and image smearing is minimized in said device.

2. An electrophotographic process which comprises the generation of a latent image in an electronic printing MICR apparatus; thereafter developing the image with a toner composition comprised of resin particles, magnetite particles, and an aliphatic hydrocarbon, or an additive component comprised of polymeric alcohol of the formula $$CH_3(CH_2)_nCH_2OH$$

wherein n is a number of from about 30 to about 500; and subsequently providing the developed image with magnetic ink characters thereon to a reader/sorter device whereby toner offsetting and image smearing is minimized in said device.

3. A process in accordance with claim 1 wherein the toner composition contains pigment particles.

4. A process in accordance with claim 2 wherein the toner composition contains pigment particles.

5. A process in accordance with claim 1 wherein the toner composition contains magnetite particles in an amount of from about 30 to about 70 percent by weight, and pigment particles in an amount of from about 2 to about 10 percent by weight.

6. A process in accordance with claim 2 wherein the toner composition contains magnetite particles in an amount of from about 30 to about 70 percent by weight, and pigment particles in an amount of from about 2 to about 10 percent by weight.

7. A process in accordance with claims 1 or 2 wherein a soft roll fuser is selected for affixing the developed latent images.

8. A process in accordance with claims 1 or 2 wherein n is a number of from about 30 to about 300.

9. A process in accordance with claims 1 or 2 wherein the polymeric alcohol wax has a number average molecular weight of from about 475 to about 1,400.

10. A process in accordance with claims 1 or 2 wherein the polymeric alcohol wax has a number average molecular weight of from about 475 to about 750.

11. A process in accordance with claims 1 or 2 wherein the polymeric alcohol is present as an internal component.

12. A process in accordance with claims 1 or 2 wherein the polymeric alcohol is present in an amount of from about 1 percent by weight to about 20 percent by weight.

13. A process in accordance with claims 1 or 2 wherein the resin particles are selected from the group consisting of polyesters, styrene butadiene copolymers, styrene acrylate copolymers, and styrene methacrylate copolymers.

14. A process in accordance with claim 13 wherein the styrene butadiene copolymer contains 91 percent by weight of styrene, and 9 percent by weight of butadiene.

15. A process in accordance with claims 1 or 2 wherein the magnetite is present in an amount of from about 30 to about 70 percent by weight.

16. A process in accordance with claims 1 or 2 wherein the magnetite is acicular and is present in an amount of from about 15 to about 40 percent by weight.

17. A process in accordance with claims 1 or 2 wherein the magnetite is cubic and is present in an amount of from about 50 to about 60 percent by weight.

18. A process in accordance with claims 1 or 2 wherein the toner composition contains a charge enhancing additive.

19. A process in accordance with claim 18 wherein the charge enhancing additive is selected from the group consisting of distearyl dimethyl ammonium methylsulfate, cetyl pyridinium halides, and stearyl phenethyl dimethyl ammonium tosylates.

20. A process in accordance with claim 18 wherein the charge enhancing additive is selected from the group consisting of Spilon TRH, or a potassium tetraphenyl borate.

21. A process in accordance with claim 18 wherein the charge enhancing additive is present in an amount of from about 0.05 percent by weight to about less than 5 percent by weight.

22. A process for processing personal checks which comprises generating images in an electronic printing device; developing the images with a developer composition comprised of a toner containing resin particles having dispersed therein pigment particles, and a component comprised of polymeric alcohols of the formula $$CH_3(CH_2)_nCH_2OH$$

wherein n is a number of from about 30 to about 500, and carrier particles; transferring the images to a substrate; fusing the images thereto; and subsequently providing the checks with magnetic ink characters thereon to a reader/sorter device whereby toner offsetting and image smearing is substantially avoided.

23. A process in accordance with claim 22 wherein the resulting checks are utilized in the IBM 3890 or NCR 6780 reader/sorter device, and wherein image smearing and image offsetting is substantially avoided.

24. A process in accordance with claim 22 wherein the resulting checks are utilized in a reader/sorter device, and wherein image smearing and image offsetting to the read and write heads is substantially avoided.

25. A process in accordance with claim 22 wherein the resulting checks are utilized in a reader/sorter device, and wherein image smearing and image offsetting to a protective foil present on the read and write heads is avoided.

26. A process in accordance with claim 22 wherein the reject rate in the reader/sorter device is less than one half of one percent.

27. A xerographic process which comprises generating latent images with high or low speed electronic printing devices; thereafter developing the image with a developed composition comprised of a toner composition containing resin particles, magnetite particles, and a component comprised of aliphatic hydrocarbons, or polymeric alcohols of the formula $$(CH_3(CH_2)_nCH_2OH$$

wherein n is a number of from about 30 to about 500, and carrier particles; and subsequently providing the checks with magnetic ink characters thereon to a reader/sorter device whereby toner offsetting and image smearing is substantially avoided.

28. A process in accordance with claim 27 wherein the carrier particles contain a polymeric coating thereover.

29. A process in accordance with claim 28 wherein the carrier particles are comprised of a steel or a ferrite core with a coating thereover selected from the group consisting of polychlorotrifluoroethylene-covinylchloride copolymer, a polyvinylidene fluoropolymer, or a terpolymer of styrene, methacrylate, and an organo silane, fluorinated ethylenepropylene copolymers, and polytetrafluoroethylene.

30. A process in accordance with claim 28 wherein the toner contains a charge enhancing additive.

31. A process in accordance with claim 30 wherein the charge enhancing additive is distearyl dimethyl ammonium methyl sulfate.

32. A process in accordance with claims 1 or 2 wherein the read/write heads are free of image smearing after the documents generated are passed through a magnetic ink character recognition sorter, and the reject rate is less than one half of one percent.

33. A process in accordance with claim 28 wherein toner offsetting is avoided after the documents generated are passed through a magnetic ink character recognition sorter.

34. A process which comprises the formation of a latent image on a photoconductive member in an electronic imaging apparatus; developing the image with a toner composition comprised of resin particles having dispersed therein magnetitie particles, and a component comprised of aliphatic hydrocarbons or polymeric alcohols of the formula $$CH_3(CH_2)_nCH_2OH$$

wherein n is a number of from about 30 to about 500; subsequently transferring the image to a supporting substrate; fixing the image; and applying to the developed image during or subsequent to fusing a layer of said polymeric alcohol; and a subsequently providing the documents with magnetic ink characters thereon to a reader/sorter device whereby toner offsetting and image smearing is substantially avoided.

35. A xerographic process which comprises forming a latent image on an imaging member; developing the image with a toner composition comprised of resin particles, magnetite particles, and optional additive particles; subsequently transferring the image to a suitable substrate; fixing the image thereto; thereafter applying to the developed image a polymeric alcohol of the formula $$CH_3(CH_2)_nCH_2OH$$

wherein n is a number of from about 30 to about 500; and subsequently providing the documents with magnetic ink characters thereon to a reader/sorter device whereby toner offsetting and image smearing is substantially avoided.

36. A process in accordance with claims 1 or 2 wherein the additive is an aliphatic hydrocarbon with functional groups thereon selected from the group consisting of aldehyde, carboxylic acid, carboxylic ester, and an amide.

37. A process in accordance with claim 36 wherein the additive is a Bareco wax.

38. A process in accordance with claims 1 or 2 wherein there is added to the toner composition carrier particles.

39. A process in accordance with claims 1 or 2 wherein the toner composition contains pigment particles.

40. A process in accordance with claim 21 wherein there is added to the toner composition carrier particles.

41. A process in accordance with claim 21 wherein a soft fuser roll is selected for affixing the developed image.

42. A process in accordance with claim 27 wherein the toner contains pigment particles.

43. A xerographic process which comprises generating latent images with high or low speed electronic printing devices; thereafter developing the image with a developer composition comprised of a toner composition containing resin particles, magnetite particles, and a component comprised of aliphatic hydrocarbons, or polymeric alcohols of the formula $CH_3(CH_2)_nCH_2OH$ wherein n is a number of from about 30 to about 300; and subsequently providing the checks with magnetic ink characters thereon to a reader/sorter device whereby toner offsetting and image smearing is substantially avoided.

44. A process in accordance with claim 34 wherein n is a member of from about 30 to about 300.

45. A process in accordance with claim 34 wherein carrier particles are added to the toner composition, or the toner composition is added to the carrier particles.

* * * * *